US008761424B2

(12) United States Patent
Wubker et al.

(10) Patent No.: US 8,761,424 B2
(45) Date of Patent: Jun. 24, 2014

(54) EARPHONE SLEEVE ASSEMBLY HAVING INTEGRAL BARRIER

(75) Inventors: John James Wubker, Lindenhurst, IL (US); Blake Anthony Lanciloti, Chicago, IL (US); Kyle Patrick Glavan, Arlington Heights, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 25 days.

(21) Appl. No.: 13/256,398

(22) PCT Filed: Jun. 18, 2010

(86) PCT No.: PCT/US2010/039166

§ 371 (c)(1),
(2), (4) Date: Sep. 13, 2011

(87) PCT Pub. No.: WO2010/151492

PCT Pub. Date: Dec. 29, 2010

(65) Prior Publication Data

US 2012/0082336 A1 Apr. 5, 2012

Related U.S. Application Data

(60) Provisional application No. 61/219,049, filed on Jun. 22, 2009.

(51) Int. Cl.
*H04R 25/00* (2006.01)

(52) U.S. Cl.
USPC ..... 381/325; 381/380

(58) Field of Classification Search
USPC ..... 381/380, 325, 312; 264/267
See application file for complete search history.

(56) References Cited

U.S. PATENT DOCUMENTS

| | | | |
|---|---|---|---|
| 2,678,973 | A | 5/1954 | Newman |
| 3,408,461 | A | 10/1968 | Langford |
| 3,976,848 | A | 8/1976 | Estes |
| 4,073,366 | A | 2/1978 | Estes |

(Continued)

FOREIGN PATENT DOCUMENTS

| | | | |
|---|---|---|---|
| EP | 1956864 | A1 | 8/2008 |
| GB | 1119446 | A | 7/1968 |

OTHER PUBLICATIONS

International Search Report and Written Opinion mailed Sep. 21, 2010 (PCT/US2010/039166); ISA/EP.

(Continued)

*Primary Examiner* — Brian Ensey
(74) *Attorney, Agent, or Firm* — Banner & Witcoff, Ltd.

(57) ABSTRACT

An apparatus for blocking materials from entering the sound port of an earphone, while simultaneously allowing sound to pass through unaffected is disclosed. In an earphone having an elongated nozzle with a central opening adapted to transmit sound, a removable or replaceable a sleeve assembly having a wax guard or barrier is formed integral with the ear sleeve assembly. The barrier is mounted in a stem and is adapted to prevent materials from entering the central opening of the earphone nozzle. The stem is also adapted to receive the sleeve over its body. The sleeve can be cylindrical or tapered in shape, and the sleeve can be adapted to aid in blocking ambient noise. The barrier, the stem, and the sleeve can all be formed as an integral one-piece assembly, and the entire one-piece assembly can be adapted to be changed by the user.

29 Claims, 4 Drawing Sheets

(56) References Cited

U.S. PATENT DOCUMENTS

| | | | | |
|---|---|---|---|---|
| 4,553,627 | A | 11/1985 | Gastmeier et al. | |
| 4,706,778 | A | 11/1987 | Topholm | |
| 4,800,982 | A | 1/1989 | Carlson | |
| 4,870,689 | A | 9/1989 | Weiss | |
| 4,879,750 | A | 11/1989 | Nassler | |
| 4,880,076 | A | 11/1989 | Ahlberg et al. | |
| 4,945,569 | A | 7/1990 | Kulman | |
| 4,949,377 | A | 8/1990 | Nishina et al. | |
| 4,972,488 | A | 11/1990 | Weiss et al. | |
| 4,987,597 | A * | 1/1991 | Haertl | 381/325 |
| 5,002,151 | A | 3/1991 | Oliveira et al. | |
| 5,105,904 | A | 4/1992 | Olsen | |
| 5,131,128 | A | 7/1992 | Bisgaard et al. | |
| 5,136,640 | A | 8/1992 | Kim | |
| 5,278,360 | A | 1/1994 | Carbe et al. | |
| 5,401,920 | A | 3/1995 | Oliveira | |
| 5,864,628 | A | 1/1999 | Posen et al. | |
| 5,970,157 | A | 10/1999 | Yoest | |
| 6,129,174 | A * | 10/2000 | Brown et al. | 381/325 |
| 6,134,333 | A | 10/2000 | Flagler | |
| 6,164,409 | A | 12/2000 | Berger | |
| 6,671,381 | B1 | 12/2003 | Lux-Wellenhof | |
| 6,795,562 | B1 | 9/2004 | Gunnersen et al. | |
| 7,551,747 | B2 * | 6/2009 | Huynh et al. | 381/325 |
| 8,019,106 | B2 * | 9/2011 | Gunnersen et al. | 381/325 |
| 2002/0136420 | A1 | 9/2002 | Topholm | |
| 2003/0044037 | A1 | 3/2003 | Park | |
| 2003/0198360 | A1 | 10/2003 | Niederdrank | |
| 2003/0198361 | A1 | 10/2003 | Heerlein et al. | |
| 2004/0105562 | A1 | 6/2004 | Kulman | |
| 2004/0240694 | A1 | 12/2004 | Wolf | |
| 2005/0271229 | A1 | 12/2005 | Hanses et al. | |
| 2006/0098836 | A1 | 5/2006 | Sabick et al. | |
| 2006/0147071 | A1 | 7/2006 | Neilson | |
| 2006/0153418 | A1 | 7/2006 | Van Halteren | |
| 2006/0239485 | A1 | 10/2006 | Niederdrank | |
| 2006/0256990 | A1 | 11/2006 | Holmes | |
| 2007/0003086 | A1 | 1/2007 | Tilson et al. | |
| 2007/0086611 | A1 | 4/2007 | Rafferty | |
| 2007/0154043 | A1 | 7/2007 | Gebert | |
| 2007/0206826 | A1 | 9/2007 | Roehrlein | |
| 2007/0223759 | A1 | 9/2007 | Ach-Kowalewski | |
| 2008/0019549 | A1 * | 1/2008 | Ochsenbein | 381/325 |
| 2008/0118095 | A1 | 5/2008 | Fletcher | |
| 2008/0187161 | A1 * | 8/2008 | Tiemens et al. | 381/380 |
| 2009/0154747 | A1 | 6/2009 | Vestergaard et al. | |
| 2011/0085688 | A1 * | 4/2011 | Ram et al. | 381/325 |

OTHER PUBLICATIONS

Hal-Hen Catalog 1979. See the "Filter Insert Canal Tip" on p. 7; catalog #2107.

* cited by examiner

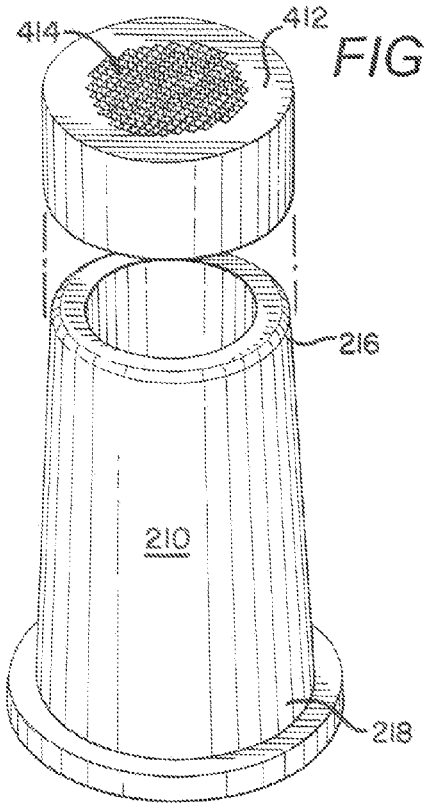
FIG. 4C
FIG. 4D
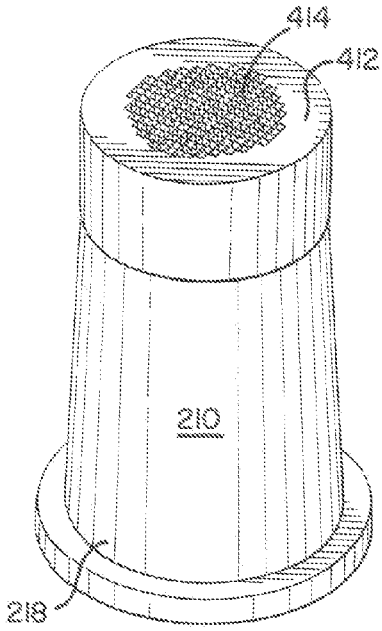
FIG. 4E
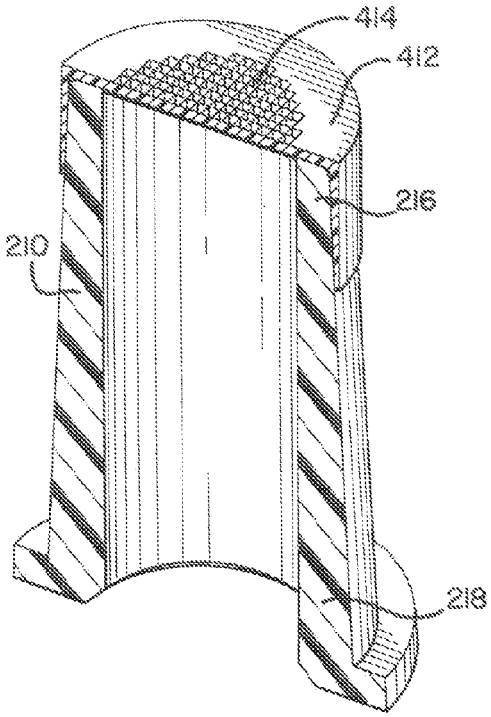
FIG. 4F
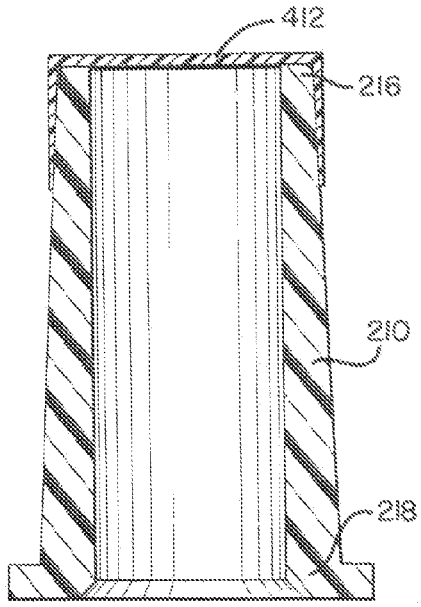

FIG. 5
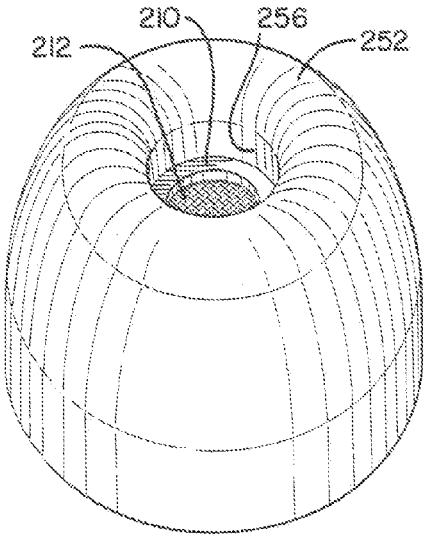
FIG. 6
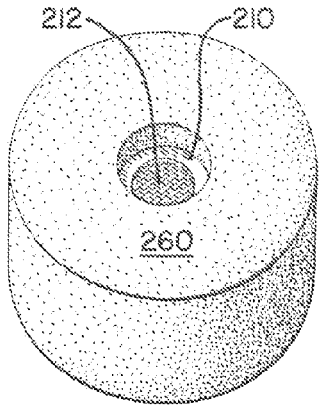
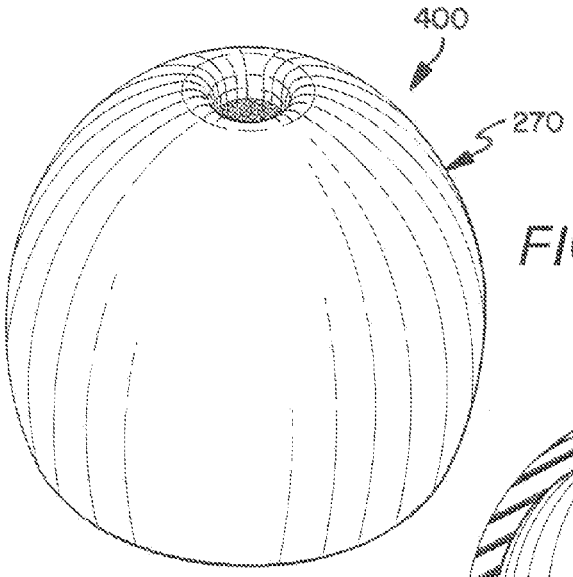
FIG. 7
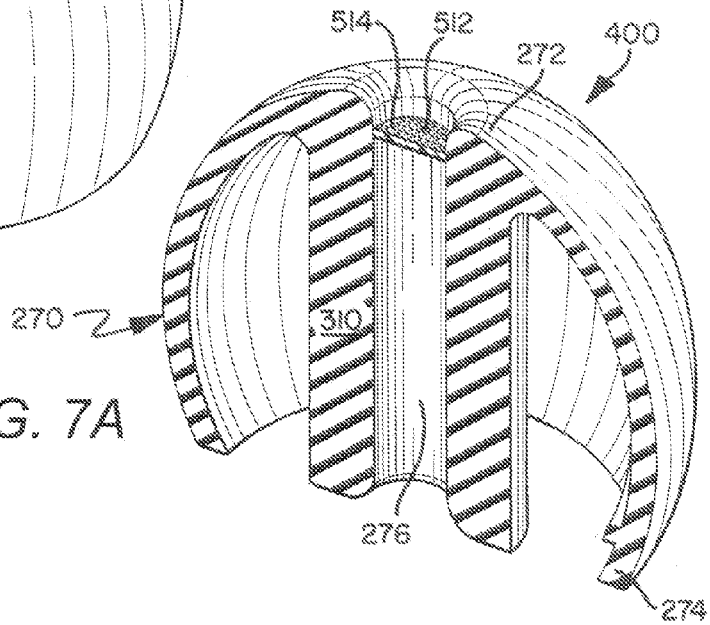
FIG. 7A

EARPHONE SLEEVE ASSEMBLY HAVING INTEGRAL BARRIER

The present application is a U.S. National Phase filing of International Application No. PCT/US2010/039166, filed Jun. 18, 2010, which claims priority to U.S. Provisional Patent Application No. 61/219,049, filed Jun. 22, 2009, both of which the present application claims priority to and the benefit of, and both of which are incorporated by reference herein in their entireties.

TECHNICAL FIELD

Aspects of the disclosure relate to earphones for in-ear listening devices ranging from hearing aids to high quality audio listening devices to consumer listening devices, and more particularly, to a device and method for preventing cerumen (earwax) and debris from entering the nozzle or sound port of an in-ear listening device.

BACKGROUND

Personal "in-ear" monitoring systems are utilized by musicians, recording studio engineers, and live sound engineers to monitor performances on stage and in the recording studio. In-ear systems deliver a music mix directly to the musician's or engineer's ears without competing with other stage or studio sounds. These systems provide the musician or engineer with increased control over the balance and volume of instruments and tracks, and serve to protect the musician's or engineer's hearing through better sound quality at a lower volume setting. In-ear monitoring systems offer an improved alternative to conventional floor wedges or speakers, and in turn, have significantly changed the way musicians and sound engineers work on stage and in the studio.

Moreover, many consumers desire high quality audio sound, whether they are listening to music, DVD soundtracks, podcasts, or mobile telephone conversations. Users may desire small earphones. Users may also desire earphones that effectively block background ambient sounds from the user's outside environment.

Hearing aids, in-ear systems, and consumer listening devices typically utilize earphones that are engaged at least partially inside of the ear of the listener. Typical earphones have a driver mounted within a housing. Sound is conveyed from the output of the driver through a cylindrical sound port or a nozzle. A suitable ear device couples the sound port to the ear of the listener. As material such as earwax, dust, dirt, and debris may enter the sound port, they can potentially clog up the passageway that the sound passes through, blocking sound transmission and causing changes in frequency response, which can in turn affect sound quality. Additionally this may affect the internal components of the earphone rendering it inoperable. For example, outside materials can enter the sound port and alter the dampener.

BRIEF SUMMARY

One exemplary embodiment disclosed herein relates to a device for blocking materials from entering the sound port of an earphone, while simultaneously allowing sound to pass through unaffected. In one exemplary embodiment, a wax guard or barrier that is formed integral with a removable or replaceable ear sleeve assembly is disclosed.

In one exemplary embodiment an earphone having an elongated nozzle with a central opening adapted to transmit sound and a sleeve assembly is disclosed. The sleeve assembly can consist of a first opening and a second opening, a sleeve adapted for placement in the ear of a user, and a stem having an elongated body.

In another exemplary embodiment the stem body is tapered and has a first end and a second end. A barrier is mounted in the stem and is adapted to prevent materials from entering the central opening of the earphone nozzle. The stem is also adapted to receive the sleeve over its body, and the second opening in the stem is adapted to receive the nozzle therein. The sleeve can be cylindrical or tapered in shape, and the sleeve can be adapted to aid in blocking outside ambient noise. The stem, the barrier, and the sleeve can all be formed as an integral one-piece assembly, and the entire one-piece assembly can be adapted to be changed by the user.

In another exemplary embodiment the barrier is a grid and is formed of a woven material and comprises openings large enough to allow sound to pass through unaffected and small enough to prevent wax and debris to pass there through. The stem has a first opening and a second opening. The first opening can extend from the first end to the barrier, and the second opening can extend from the second opening to the barrier. The barrier can be placed nearer to the first end than to the second end of the stem.

These and other features of the present invention may best be understood with reference to the accompanying drawings and in the following detailed description of the invention.

BRIEF DESCRIPTION OF THE DRAWINGS

In the drawings, the figures have the following general nature:

FIG. 4C depicts an exploded isometric view of another alternative stem embodiment.

FIG. 4D depicts an assembled isometric view of the stem embodiment shown in FIG. 4C.

FIG. 4E depicts an isometric, cross-sectional view of the stem embodiment shown in FIG. 4D.

FIG. 4F depicts a cross-sectional view of the stem embodiment shown in FIG. 4D.

FIG. 5 depicts an isometric view of an exemplary embodiment of a sleeve assembly.

FIG. 6 depicts an isometric view of another exemplary embodiment of a sleeve assembly.

FIG. 7 depicts an isometric view of another exemplary embodiment of a sleeve.

FIG. 7A depicts an isometric, cross-sectional view of the sleeve shown in FIG. 7.

DETAILED DESCRIPTION OF THE INVENTION

In this patent specification, the applicants use various headings only for convenience purposes. These headings are not intended in any way limit the scope of the disclosure.

Overall Earphone Assembly

Figure 1:
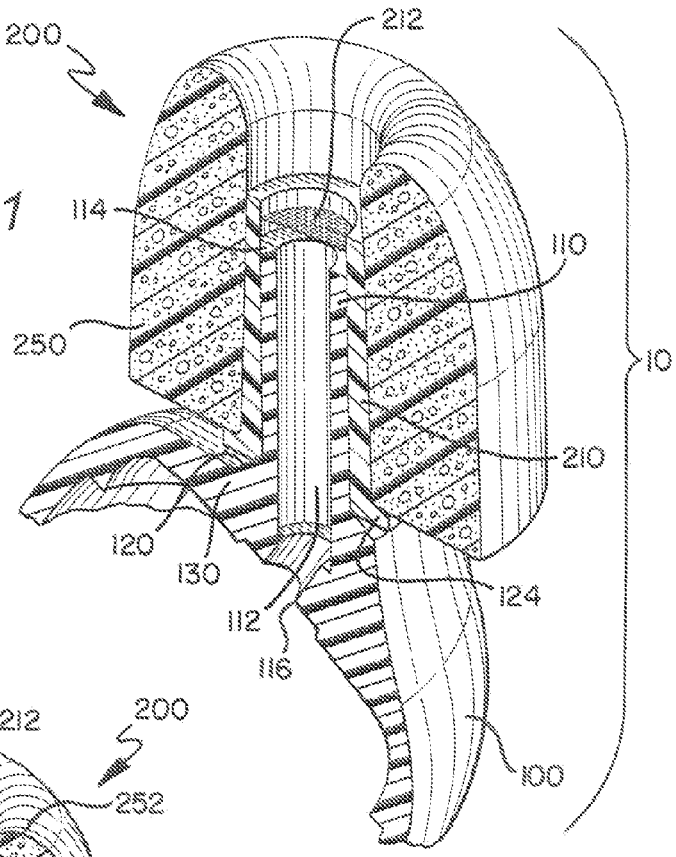
FIG. 1 depicts an isometric, cross-sectional view of an exemplary embodiment of an earphone assembly.

FIG. 1 depicts an earphone assembly 10. The earphone assembly 10 may be a component or a sub-component of any in-ear listening device and is adapted to fit comfortably into a user's ear. The assembly 10 generally comprises an earphone 100 and a sleeve assembly 200. The sleeve assembly 200 can comprise a sleeve 250, a stem 210, and a barrier or wax guard 212 mounted in the stem 210. The sleeve 250, the stem 210, and the barrier 212 can be formed together as a one-piece construction to form the sleeve assembly 200. However, it is contemplated that these components could be formed separately.

Earphone

The earphone 100 may be formed integrally with or attached to any listening device by any method known in the art. The listening device may be used with a sound transmitting device, such as a wireless bodypack receiver, an MP3 player, Apple® iPhone or mobile telephone. As shown in FIG. 1, the earphone is formed with an earphone shell 130, a shoulder 120, and a nozzle 110. The shell 130 forms a housing for receiving a driver and other internal components of the listening device. The shoulder 120 has an angled surface which abuts the stem 210 to act as an indicator that the nozzle 110 has been properly placed into the sleeve assembly 200. The nozzle 110 directs the sound from the driver to the ear of the user.

The nozzle 110 can have an elongated shape for receiving the sleeve assembly 200. The nozzle 110 has a central opening 112 extending there through and an open first nozzle end 114 and an open second nozzle end 116 for transmitting sound. The open second nozzle end 116 receives the sound from the driver and projects the sound through the central opening 112 out of the open first nozzle end 114.

Stem

Figure 2:
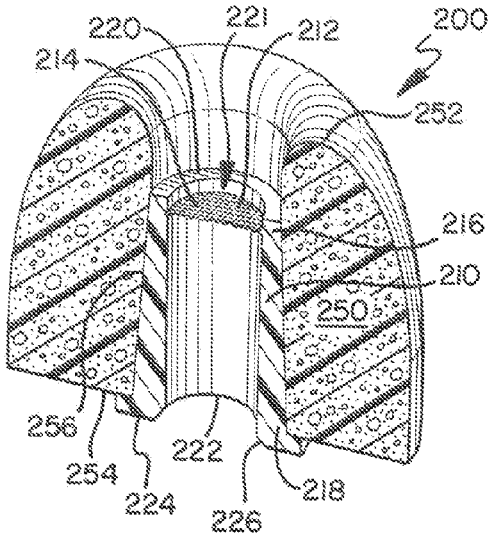
FIG. 2 depicts an isometric, cross-sectional view of an exemplary embodiment of a sleeve assembly.
Figure 4:
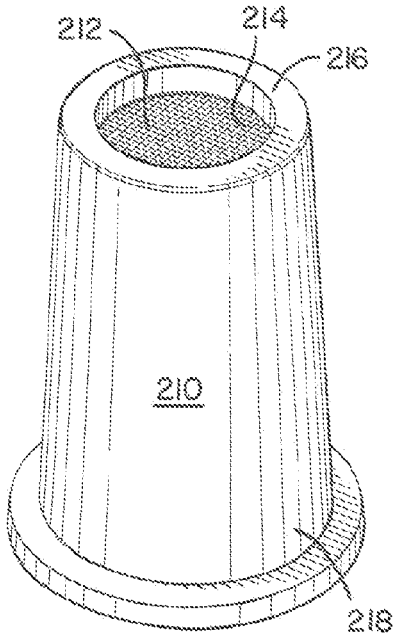
FIG. 4 depicts an isometric view of a first stem embodiment.

As shown in FIGS. 2 and 4, the stem 210 has a solid, yet flexible, elongated body and is formed with a first opening 220 and a second opening 222. The first opening 220 extends from a first end 216 of the stem to the barrier 212 and allows sound to pass through. The second opening 222 extends from the second end 218 of the stem 210 to the barrier 212 and is shaped and adapted to receive the nozzle 110. Because the barrier 212 is placed at or near the first end 216 of the stem 210 it can also act as an indicator to the user such that the user knows which end of the sleeve assembly 200 is placed onto the nozzle 110.

As discussed below, the barriers 212, 312, 412, 512 depicted in FIGS. 4-4E may comprise a disc, grid, screen, cup, or matrix and may be formed of an insert-molded woven cloth or may be molded as one piece. The barriers 212, 312, 412, 512 have openings 214, 314, 414, 514 large enough to allow sound to pass through unaffected but small enough so as to not allow wax and debris to pass through. In other words, the openings can be formed of any suitable size to ensure that wax and debris are prevented from entering into the nozzle 110 while allowing sound to pass there through. As depicted in the Figures, the openings are formed as square shaped; however, the openings can be formed of any suitable shape.

As depicted in FIG. 2, in one embodiment, the barrier 212 can be formed with the stem 210 as one piece at the same time that the stem 210 is molded. In this embodiment both the barrier 212 and the stem 210 are formed together in a precision molding operation. The stem and barrier can be formed of thermoplastic urethane (TPU), polyvinyl chloride, or any suitable soft and flexible plastic material. Although any of the methods described herein could be used to manufacture the stem 210, when the stem 210 and barrier 212 are formed as one piece, the barrier 212 may be less likely to separate from the stem 210 during use.

Figure 2A:
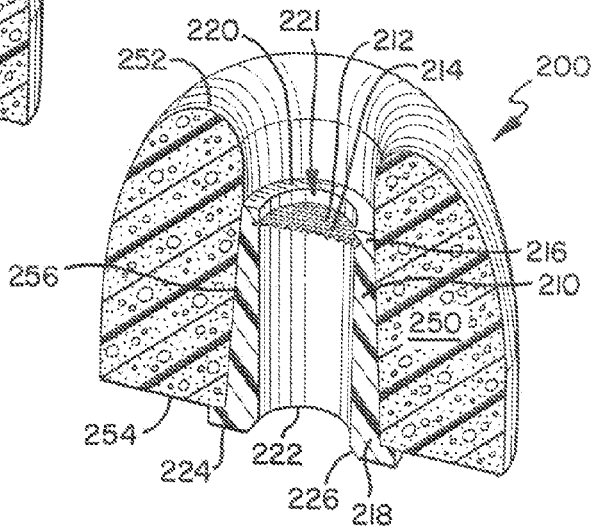
FIG. 2A depicts an isometric, cross-sectional view of another exemplary embodiment of a sleeve assembly.

As depicted in FIG. 2A, the barrier 212 can alternatively be a separate component which is integrally molded into the stem 210. The barrier 212 can formed of a cloth made of polyester thread, nylon thread, or any woven material. Alternatively, the barrier 212 can be formed of a stainless steel material. The barrier 212 may then be placed inside the mold during the molding of the stem 210, such that it is molded into the inside of the stem 210.

Figure 4A:
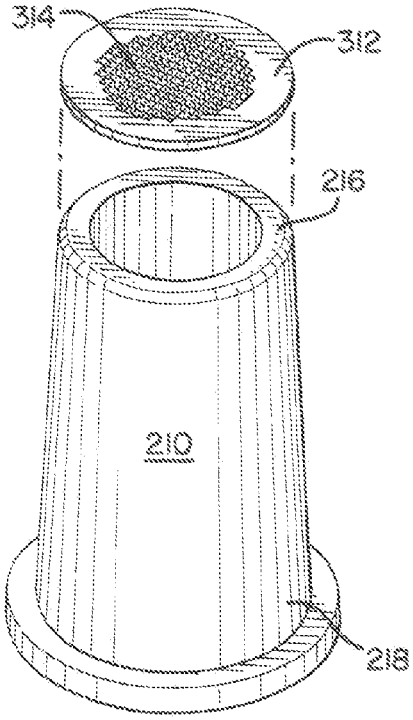
FIG. 4A depicts an exploded isometric view of an alternative stem embodiment.
Figure 4B:
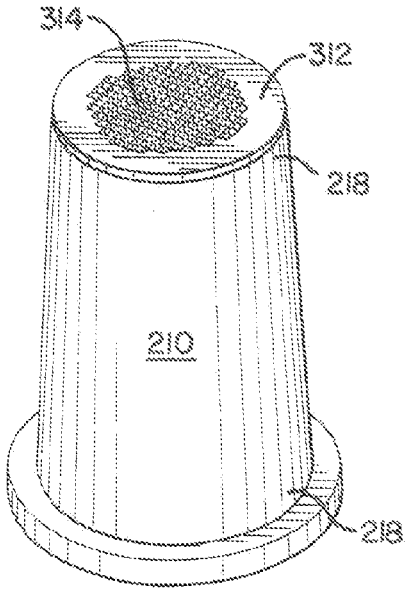
FIG. 4B depicts an assembled isometric view of the stem embodiment shown in FIG. 4A.

In another exemplary embodiment depicted in FIGS. 4A and 4B, the barrier 312 can be formed into a disc that is fastened into place over the stem 210 by any known method in the art, such as by gluing, heat sinking, and solvent bonding. The disc can be formed of the above listed materials, as well as other appropriate materials. Once formed the stem 210 is then pressed into a sleeve to form the sleeve assembly. The sleeve and bond between the barrier 312 and the stem 210 hold the barrier 312 into place on the stem 210.

In another exemplary embodiment depicted in FIGS. 4C-4F, the barrier 412 can be formed into a cup, which again can be made of any of the above listed materials, as well as other appropriate materials. The barrier 412 can be fastened into place over the stem 210 by any known method known in the art, as discussed above. Again, the stem 210 is then pressed into a sleeve to form a sleeve assembly. Like in the embodiment discussed above, the sleeve and bond between the barrier 412 and the stem 210 hold the barrier 412 into place on the stem 210.

In another exemplary embodiment, depicted in FIGS. 7 and 7A, the stem can be formed integral with the sleeve, and the sleeve can be formed of a silicone or a foam material. A separate barrier 512 with openings 514 can be formed of the materials listed above. The barrier 512 can be in-molded into the sleeve 270 to form a sleeve assembly 400. Alternatively, the barrier 512 and the sleeve 270 can be molded as one piece and formed at the same time. The sleeve assembly 400 can be used in conjunction with the earphone assembly 10 shown in FIG. 1 instead of sleeve assembly 200.

Figure 3:
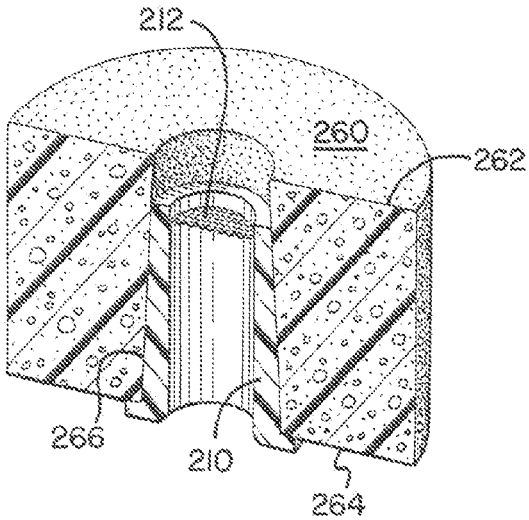
FIG. 3 depicts an isometric, cross-sectional view of yet another exemplary embodiment of a sleeve assembly.

As depicted in FIGS. 1-3, the barrier 212 can be formed longitudinally offset or displaced axially from the first end 216 and the second end 218 of the stem 210, resulting in an annular lip or rim 221 that extends past the barrier 212 toward a user's ear when the earphone is in use. The annular lip 221 provides an attachment structure for receiving the barrier 212 if it is molded into the stem 212 for easier manufacturability. Additionally, as depicted in FIG. 2, the barrier 212 can be placed nearer to the first end than to the second end of the stem 210. Although in the Figures the barrier 212 is depicted longitudinally offset from the first end 216, the barrier 212 can be placed directly over the first opening 220 at the first end 216 as shown in FIGS. 4A and 4B.

As depicted in FIG. 1, the stem 210 can act as an intermediate component between the sleeve 250 and the nozzle 110 and provides structural rigidity and integrity to the sleeve assembly 200. The stem 210 can be integrally molded to the sleeve 250 or can also be glued thereon to form the sleeve assembly 200. The stem can be formed with a flange 224, which contacts the sleeves 250, 260 on one side and the earphone 100 on the other side. The flange 224 can be formed with an angular portion 226 which contacts a correspondingly angled shoulder 120 on the earphone 100. The angular portion 226 on the flange 224 may allow for an easier assembly of the sleeve assembly 200 to the earphone 100. The stem can be formed with a tapered body to ease the assembly of the sleeves 250 to the stem 210 to form the sleeve assembly 200.

The stem 210 can be formed such that it extends past the nozzle 110 at the first end of the earphone assembly 10. This allows the barrier 212 to be placed in the first end of the stem 210 away from the nozzle 110 such that it does not contact the barrier 212 when assembled.

Sleeves

The sleeve may be formed of a compliant material to couple the earphone assembly 10 to the ear. The sleeve may be formed of a silicone material or a foam material. However, any suitable material may be used.

As shown in FIGS. 1, 2, and 5, the sleeve 250 has a first end 252, a second end 254, and a central opening 256. The sleeve 250 can be tapered and can have greater tapering proximate the first end 252. The tapering permits the sleeve 250 to be easily inserted into the ear of the user and permits the sleeve to form a seal in the user's ear such that the sleeve aids in preventing ambient noise from entering into the user's ear. In addition, the tapering proximate to the end of the sleeve 250 allows the sleeve to be compressed without blocking the opening in the first nozzle end 114. However, other sleeve shapes can be implemented to provide passive noise reduction.

As depicted in FIGS. 3 and 6, the foam sleeve 260 has a first end 262, a second end 264, and a central opening 266. The sleeve 260 is generally formed of a cylindrical shape; however, again other foam sleeve shapes are also contemplated. The foam sleeve 260 is adapted to provide a seal in the user's ear to aid in preventing ambient noise from entering into the user's ear. It is understood that the sleeve 260 can be used with the stem 210 as described herein and can be adapted to be used in conjunction with the earphone 100.

The central openings 256, 266 in the sleeves 250, 260 are adapted to receive the stem 210. The sleeves 250, 260 can be either integrally molded with the stem 210 or separately adhered to the stem 210. If the sleeves 250, 260 are adhered to the stem, the flange 224 located on the stem can provide a stop to ensure proper placement of the sleeve onto the stem and provide more surface area for attachment. Additionally, the sleeve's length may be formed longer than the stem's length to prevent the stem from coming into direct contact with the ear, thus preventing discomfort and irritation in the ear.

Another sleeve embodiment is shown in FIGS. 7 and 7A. As depicted in FIGS. 7 and 7A, the sleeve is generally formed of a spherical shape. The sleeve 270 has a first end 272, a second end 274, and a central opening 276. The stem 310 can be formed integral with the sleeve 270 at the same time in a molding operation to form the sleeve assembly 400. The sleeve 270 is also adapted to provide a seal in the user's ear to aid in preventing ambient noise from entering into the user's ear. Again it is understood that the sleeve assembly 400 can be adapted to be used in conjunction with the earphone 100.

The sleeve assemblies 200, 400 can be held onto the nozzle 110 by a secure friction-fit through normal forces acting on the nozzle 110 and the stems 210, 310. However, any other methods of securing the sleeve assemblies 200, 400 to the nozzle known in the art can also be used. A person of ordinary skill in the art would understand that both simple and complex connections are known in the art for connecting the sleeve assemblies to the nozzle, including, for example, friction/interference, barb, adhesive, ball and socket, bayonet, or screw thread.

In the embodiments shown in the Figures, the sleeve assemblies 200, 400 are held in place over the nozzle 110 solely by a friction-fit between the inner surface of the stems 210, 310 and the nozzle 110, without use of adhesives. The user can place a new sleeve assembly 200, 400 onto the nozzle 110 by aligning the nozzle 110 and the opening in the stem and by applying a force on the sleeve assembly 200, 400 in an axial direction towards the earphone 100. As sleeve assembly 200, 400 is placed onto the nozzle 110, the angled surface of the shoulder 120 abuts the stems 210, 310, which acts as an indicator that the nozzle 110 has been properly placed into the sleeve assembly 200, 400.

To remove the sleeve assembly 200, 400, while holding the earphone 100, the user simply applies a force in the axial direction away from the earphone 100, and the sleeve assembly 200, 400 is permitted to slide off of the nozzle 110. The user can then either replace the sleeve assembly 200, 400 after cleaning it, or place a new sleeve assembly onto the nozzle 110 according to the steps above. The frictional forces are such that when a user pulls the sleeve assembly 200, 400 out of his or her ear, the inner portion of the stems 210, 310 remain engaged with the nozzle 110, and the sleeve assembly 200, 400 and earphone all come out of the user's ear together. This can be accomplished without the use of adhesives to connect the sleeve assembly 200, 400 to the earphone 100.

The exemplary embodiments discussed herein may help to provide a sleeve assembly 200, 400 that may be easily changed by the user and keeps the nozzle 110 and its central opening 112 free of wax and other debris. The user may want to change the sleeve assembly as it may get damaged, soiled, uncomfortable, etc. over time. In this way, as the user changes ear sleeve assemblies for any reason they will also change the barriers or wax guards, replacing a potentially clogged wax guard with a new unclogged one. In addition, when the user identifies a problem due to wax or other debris clogging the openings 256, 266, 276 in the sleeves 250, 260, 270 respectively, they can easily solve the problem by simply changing the sleeve assembly 200, 400, which includes the barriers 212, 312. Thus, the sleeve assembly 200, 400 may eliminate or reduce the amounts of earwax or other debris reaching the central opening 112 of the nozzle 110, thereby reducing the need to clean the central opening 112.

It will be recognized by those skilled in the art that the illustrated embodiments can be modified in arrangement and detail without departing from the scope of the present invention.

What is claimed is:

1. An earphone assembly comprising:

an earphone having an elongated nozzle with an opening adapted to transmit sound; and a sleeve assembly removably coupled to the nozzle, the sleeve assembly comprising:

a sleeve adapted for placement in an ear of a user, and a stem having a solid, hollow, and elongated body, a first end, and a second end, the stem comprising a barrier adapted to prevent materials from entering the opening of the nozzle, the barrier being secured to a rim formed on an outer portion of the first end of the stem, the stem being adapted to receive the sleeve and the nozzle in the second end;

wherein the barrier acts an indicator to the user such that the user knows which end of the sleeve is placed onto the nozzle.

2. The earphone assembly according to claim 1 wherein the barrier is a grid and is formed of one of a woven material or a disc.

3. The earphone assembly according to claim 1 wherein the barrier further comprises openings large enough to allow sound to pass through and small enough to prevent wax and debris to pass through.

4. The earphone assembly according to claim 1 wherein the stem, the barrier, and the sleeve are all an integral one-piece assembly, and wherein the entire one-piece assembly is adapted to be changed by the user.

5. The earphone assembly according to claim 1 wherein the stem further comprises a flange and wherein the flange abuts the sleeve.

6. The earphone assembly according to claim 1, wherein the stem provides structural rigidity to the sleeve assembly.

7. The earphone assembly of claim 1 wherein the barrier is formed of stainless steel, thermoplastic urehtane, polyvinyl chloride, polyester thread, or nylon thread.

8. The earphone assembly of claim 1 wherein the barrier is formed with substantially square-shaped holes.

9. A method for forming a sleeve with an integral wax barrier for preventing wax and debris from entering into an earphone nozzle comprising:

forming a stem with a solid hollow and elongated body, a first end, and a second end, the second end having a first wall thickness, forming the stem with an integral barrier, wherein the stem is formed such that it can receive the earphone nozzle within its body at the second end; and forming the sleeve integral with the stem and the integral barrier in a molding operation at the same time and wherein the sleeve, the stem, and the barrier are formed of the same material and wherein the sleeve has a first end and a second end, the second end having a second wall thickness less than the first wall thickness of the second end of the stem.

10. The method according to claim 9 further comprising forming the barrier of a grid having openings large enough to allow sound to pass through and small enough to prevent wax and debris to pass through.

11. The method according to claim 9 further comprising forming the shape of the sleeve generally spherical.

12. The method according to claim 9 further comprising forming the sleeve of a silicone or foam material.

13. An earphone sleeve assembly comprising:

a hollow, elongated stem having a first end, a second end, and a passageway between the first and second ends; and a cup comprising a barrier formed with openings large enough to allow sound to pass through and small enough to prevent wax and debris to pass through, the cup positioned over a first end of the stem;

wherein a sleeve is placed over the stem and the cup holds the barrier in place on the stem and the stem is configured to receive a nozzle within the passageway, wherein the stem, the barrier, and the sleeve are all an integral one-piece assembly, and wherein the entire one-piece assembly is adapted to be changed by the user.

14. The earphone sleeve assembly according to claim 13 wherein the barrier is a grid and is formed of a woven material or a disc.

15. The earphone sleeve assembly according to claim 13 wherein the stem body is tapered from a first end to a second end.

16. The earphone sleeve assembly according to claim 13 wherein the stem further comprises a flange and wherein the flange abuts the sleeve.

17. The earphone sleeve assembly of claim 13, wherein the stem provides structural rigidity to the sleeve assembly.

18. The earphone assembly of claim 13 wherein the barrier is formed of stainless steel, thermoplastic urehtane, polyvinyl chloride, polyester thread, or nylon thread.

19. The earphone assembly of claim 13 wherein the barrier is formed with substantially square-shaped holes.

20. A method for forming a sleeve with an integral wax barrier for preventing wax and debris from entering into an earphone nozzle comprising:

forming a stem with a solid hollow and elongated body, a first end, and a second end, the second end having a first wall thickness, forming the stem with an integral barrier, wherein the stem is formed such that it can receive the earphone nozzle within its body at the second end; and wherein the barrier is in-molded into the first end of the stem by placing the barrier into the mold during the molding of the stem;

forming the sleeve with a first end and a second end and forming the second end with a second wall thickness; and wherein the first wall thickness of the stem is greater than the second wall thickness of the sleeve.

21. The method according to claim 20 further comprising forming the barrier of a grid having openings large enough to allow sound to pass through and small enough to prevent wax and debris to pass through.

22. The method according to claim 20 further comprising forming the shape of the sleeve generally spherical.

23. The method according to claim 20 further comprising forming the sleeve of a silicone or foam material.

24. The method of claim 20 wherein the barrier is formed of stainless steel, thermoplastic urehtane, polyvinyl chloride, polyester thread, or nylon thread.

25. The method of claim 20 wherein the barrier is formed with substantially square-shaped holes.

26. An earphone sleeve assembly comprising:

a sleeve adapted for placement in the ear of a user, and a stem having a solid, hollow, and elongated body having a first end, and a second end, the stem comprising a barrier adapted to prevent materials from entering the opening of the nozzle, the barrier being secured to a rim formed on an outer portion of the first end of the stem, the stem being adapted to receive the sleeve and the nozzle;

wherein the barrier acts an indicator to the user such that the user knows which end of the sleeve is placed onto the nozzle.

27. The earphone sleeve assembly according to claim 26 wherein the barrier is a grid and is formed of one of a woven material or a disc.

28. The earphone sleeve assembly according to claim 26 wherein the barrier further comprises openings large enough to allow sound to pass through and small enough to prevent wax and debris to pass through.

29. The earphone sleeve assembly according to claim 28 wherein the barrier is formed with substantially square-shaped holes.

* * * * *